US010791831B1

(12) United States Patent
Tanner

(10) Patent No.: US 10,791,831 B1
(45) Date of Patent: Oct. 6, 2020

(54) TABLE FOOTREST APPARATUS

(71) Applicant: James Tanner, Rossville, GA (US)

(72) Inventor: James Tanner, Rossville, GA (US)

( * ) Notice: Subject to any disclaimer, the term of this patent is extended or adjusted under 35 U.S.C. 154(b) by 1 day.

(21) Appl. No.: 16/432,309

(22) Filed: Jun. 5, 2019

(51) Int. Cl.

| | |
|---|---|
| ***A47B 83/02*** | (2006.01) |
| ***A47B 37/04*** | (2006.01) |
| *E04H 12/22* | (2006.01) |
| *A45B 23/00* | (2006.01) |

(52) U.S. Cl.
CPC ..... *A47B 83/02* (2013.01); *A47B 37/04* (2013.01); *A45B 23/00* (2013.01); *A45B 2200/1063* (2013.01); *A47B 2200/0097* (2013.01); *E04H 12/2238* (2013.01)

(58) Field of Classification Search
CPC ..... A47B 83/02; A47B 37/04; A47B 23/00; A47B 2200/1063; A47B 2200/0097; A47B 97/00; A47B 13/00; A47B 21/007; A47B 45/00; E04H 12/2238; Y10T 24/1498; Y10T 403/7147; Y10T 403/7164; Y10T 403/7194; B65D 63/00; B65D 63/02; B65D 63/10; A47C 7/52; A47C 16/02
USPC ..... 108/90, 93, 50.12, 50.14; 248/499, 505; 297/423.4; 211/183
See application file for complete search history.

(56) References Cited

U.S. PATENT DOCUMENTS 2,127,790 A * 8/1938 Gayden Smoot ..... A01K 97/10 248/533
2,954,635 A * 10/1960 Stotter ..... A47G 11/003 108/90
3,306,692 A * 2/1967 Timmerman ..... A47B 17/003 312/231
3,696,763 A * 10/1972 Evans ..... A47B 47/03 108/157.13
3,869,993 A 3/1975 Edlund
3,971,608 A * 7/1976 Gans ..... A47B 47/04 312/257.1
4,032,246 A * 6/1977 Waara ..... F16B 7/0493 403/390
4,139,247 A * 2/1979 Karashima ..... A47B 96/027 108/137
4,910,818 A * 3/1990 Grabill ..... A47C 20/021 297/423.17
5,104,179 A 4/1992 Jones
5,848,712 A 12/1998 Weir
5,954,208 A * 9/1999 Schultz ..... H01H 9/025 174/535
7,666,483 B2 * 2/2010 Barthelmess ..... A41G 1/007 428/19
7,748,786 B1 7/2010 Brower
(Continued)

*Primary Examiner* — Janet M Wilkens

(57) ABSTRACT

A table footrest apparatus for adding a footrest to a table includes a pair of mounting channels each having a first end, a second end, a top side, and a bottom side. The top side has a plurality of mounting apertures extending through the bottom side. Each of the pair of mounting channels is configured to span across a leg support ring of a table such that the plurality of mounting apertures is above the leg support ring. A plurality of ties is coupled to the pair of mounting channels. A pair of channel covers is selectively engageable with the top side of the pair of mounting channels. A plurality of adhesive strips is coupled to the pair of channel covers. A foot pad is coupled to the pair of channel covers and is selectively engageable with the plurality of adhesive strips.

11 Claims, 5 Drawing Sheets

(56) References Cited

U.S. PATENT DOCUMENTS

| | | | | |
|---|---|---|---|---|
| 7,891,306 | B2 * | 2/2011 | Yamashita | A47C 9/08 108/93 |
| 8,196,344 | B1 * | 6/2012 | Roberts | A01G 9/12 47/45 |
| 8,387,544 | B1 * | 3/2013 | Lee | A47B 13/08 108/161 |
| 8,720,349 | B1 | 5/2014 | David | |
| 8,899,162 | B2 * | 12/2014 | Chikkakalbalu | A47B 96/028 108/108 |
| 9,833,063 | B2 * | 12/2017 | Blick | B25H 1/16 |
| 10,426,260 | B2 * | 10/2019 | Benden | A47B 13/00 |
| 10,448,732 | B2 * | 10/2019 | Asmuth | A47B 13/02 |
| 2004/0216645 | A1 * | 11/2004 | Lin | A47B 3/08 108/50.01 |
| 2009/0120477 | A1 | 5/2009 | Li | |
| 2012/0199707 | A1 * | 8/2012 | Ortega | F16B 12/52 248/165 |
| 2013/0015156 | A1 * | 1/2013 | Trover | A47B 96/021 211/183 |
| 2013/0026316 | A1 * | 1/2013 | Case | B65D 63/04 248/205.1 |
| 2013/0239943 | A1 * | 9/2013 | James | A47B 97/00 126/58 |

* cited by examiner

TABLE FOOTREST APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to footrests and more particularly pertains to a new footrest for adding a footrest to a table.

BRIEF SUMMARY OF THE INVENTION

An embodiment of the disclosure meets the needs presented above by generally comprising a pair of mounting channels. Each of the pair of mounting channels has a first end, a second end, a top side, and a bottom side. The top side has a plurality of mounting apertures extending through the bottom side comprising a plurality of first mounting apertures adjacent the first end and a plurality of second mounting apertures adjacent the second end. Each of the pair of mounting channels is configured to span across a leg support ring of a table such that the plurality of mounting apertures are above the leg support ring. A plurality of ties is coupled to the pair of mounting channels. Each of the plurality of ties is slidably engageable through the plurality of mounting apertures and is configured to secure the pair of mounting channels to the leg support ring of the table. A pair of channel covers is selectively engageable with the top side of the pair of mounting channels. A plurality of adhesive strips is coupled to the pair of channel covers. The plurality of adhesive strips is coupled to an upper face of each of the pair of channel covers. A foot pad is coupled to the pair of channel covers and is selectively engageable with the plurality of adhesive strips.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
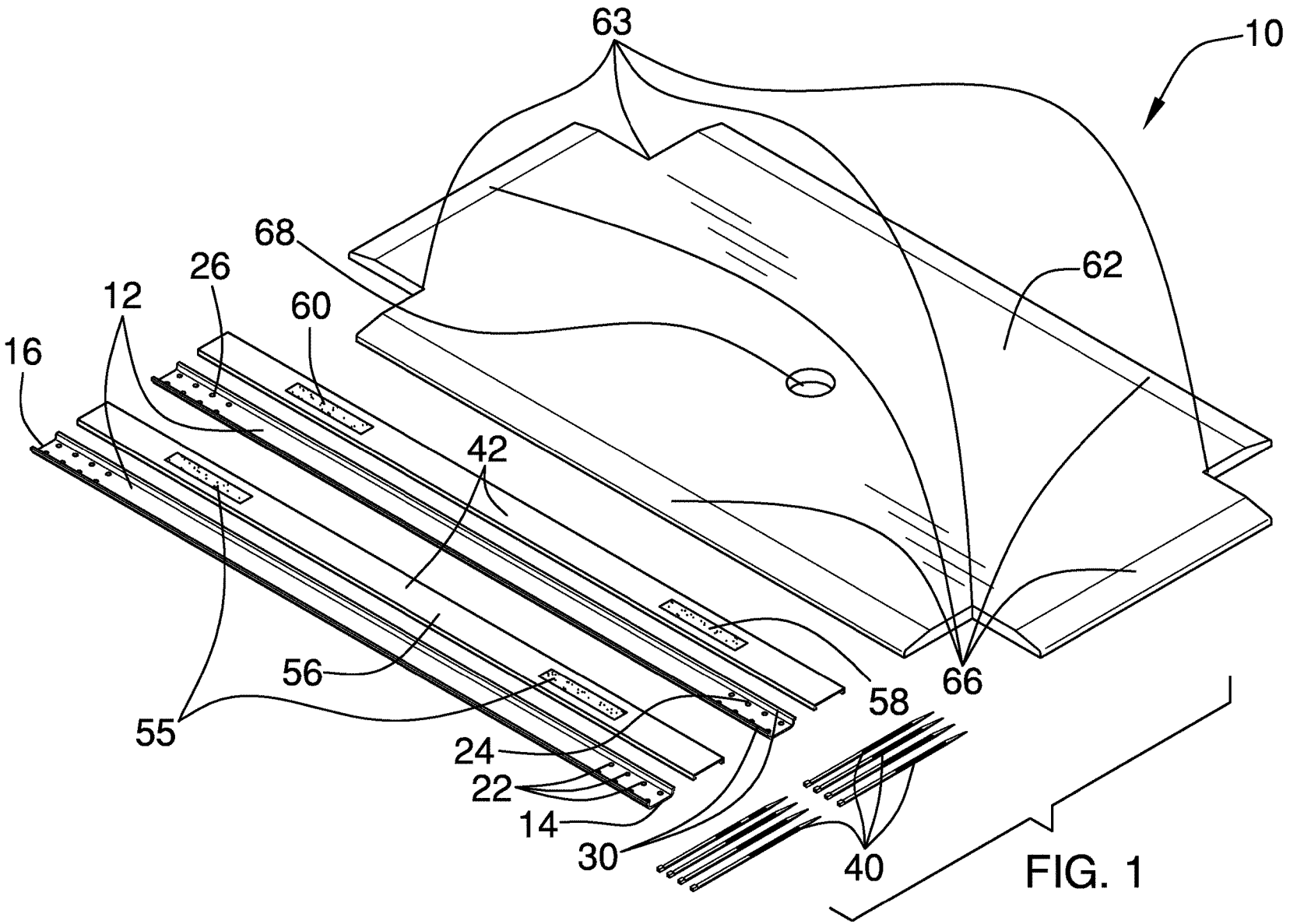
FIG. 1 is an isometric view of a table footrest apparatus according to an embodiment of the disclosure.
Figure 2:
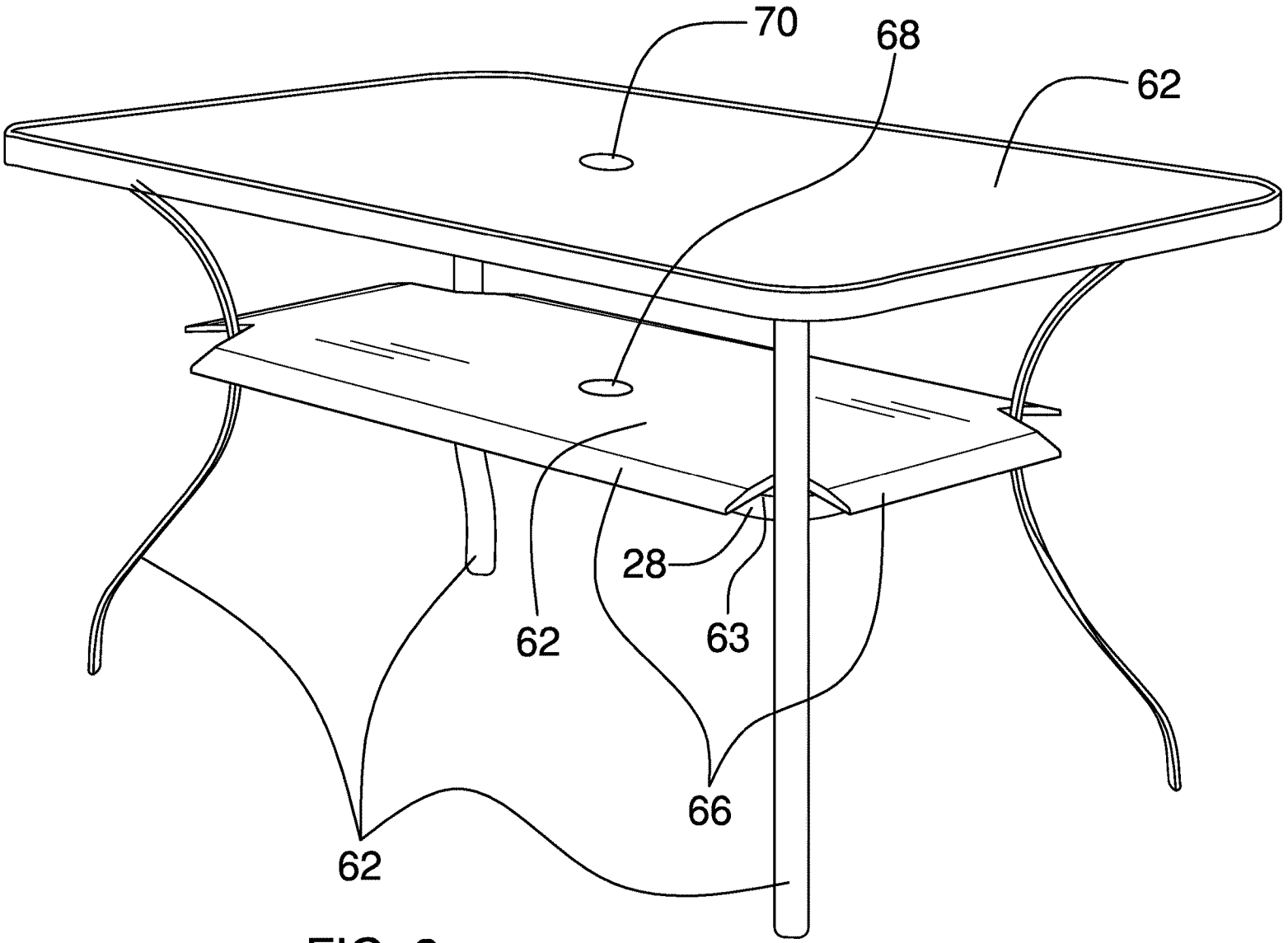
FIG. 2 is an isometric in-use view of an embodiment of the disclosure.
Figure 3:
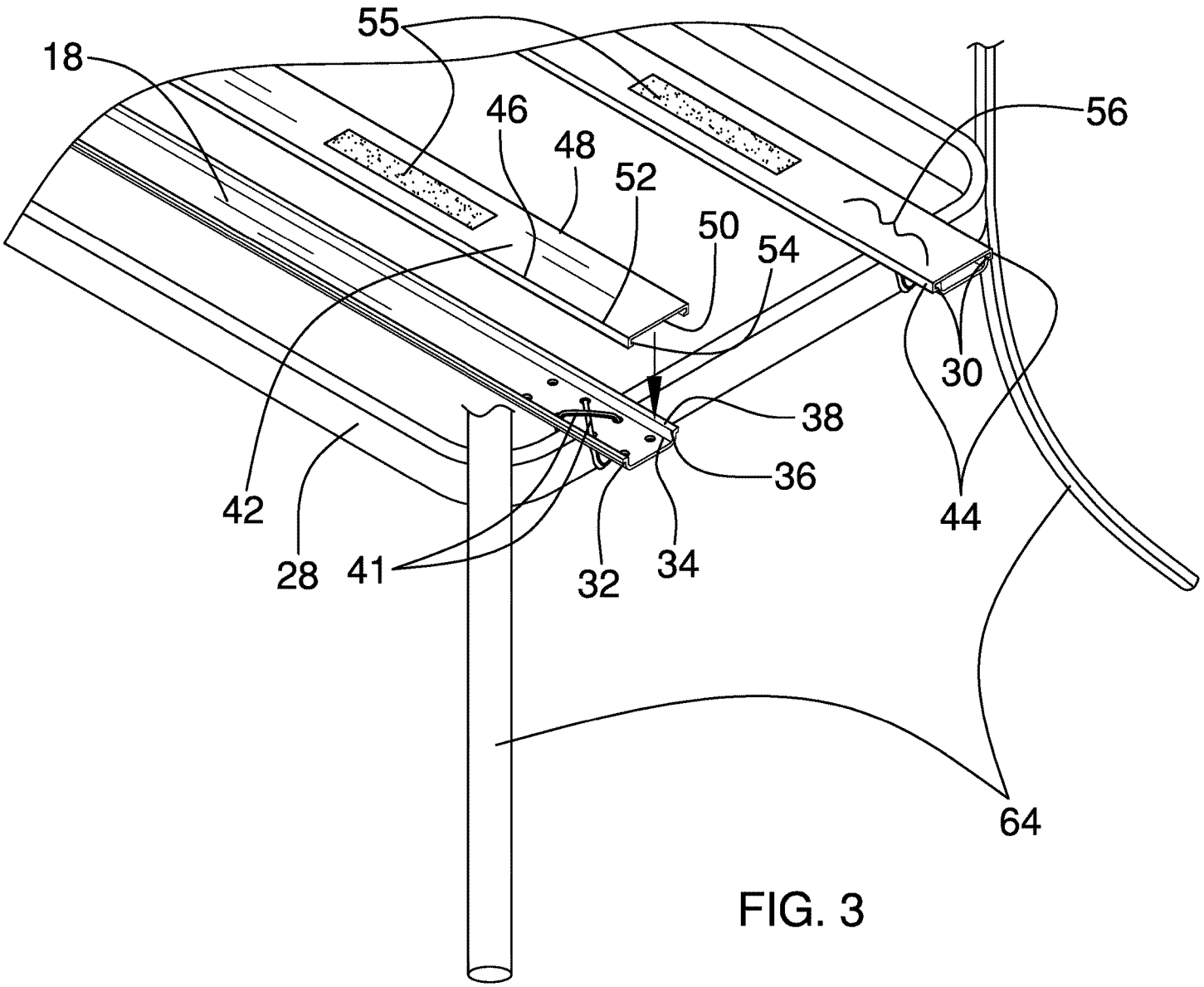
FIG. 3 is an isometric view of an embodiment of the disclosure.
Figure 4:
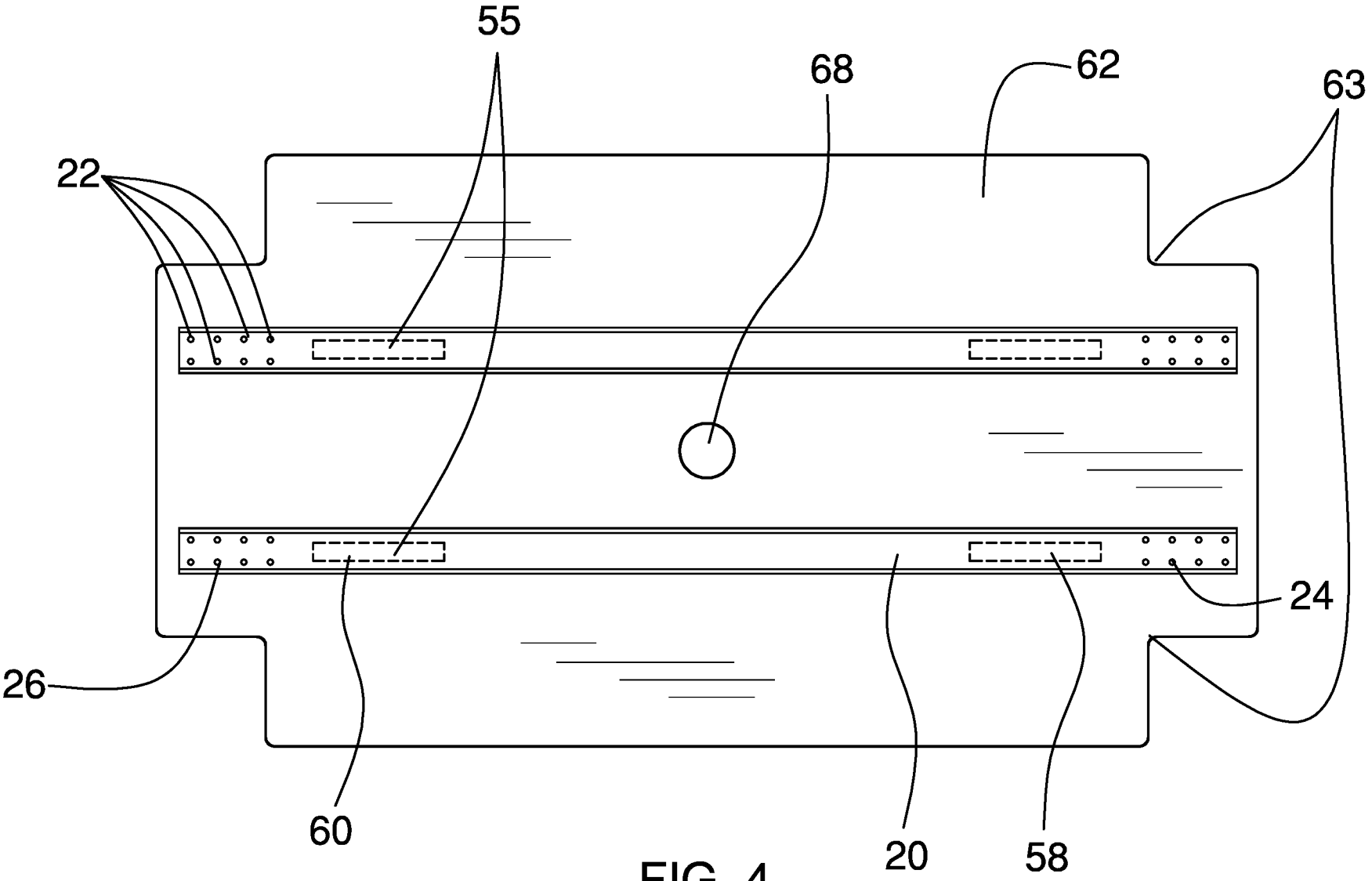
FIG. 4 is a bottom plan view of an embodiment of the disclosure.
Figure 5:
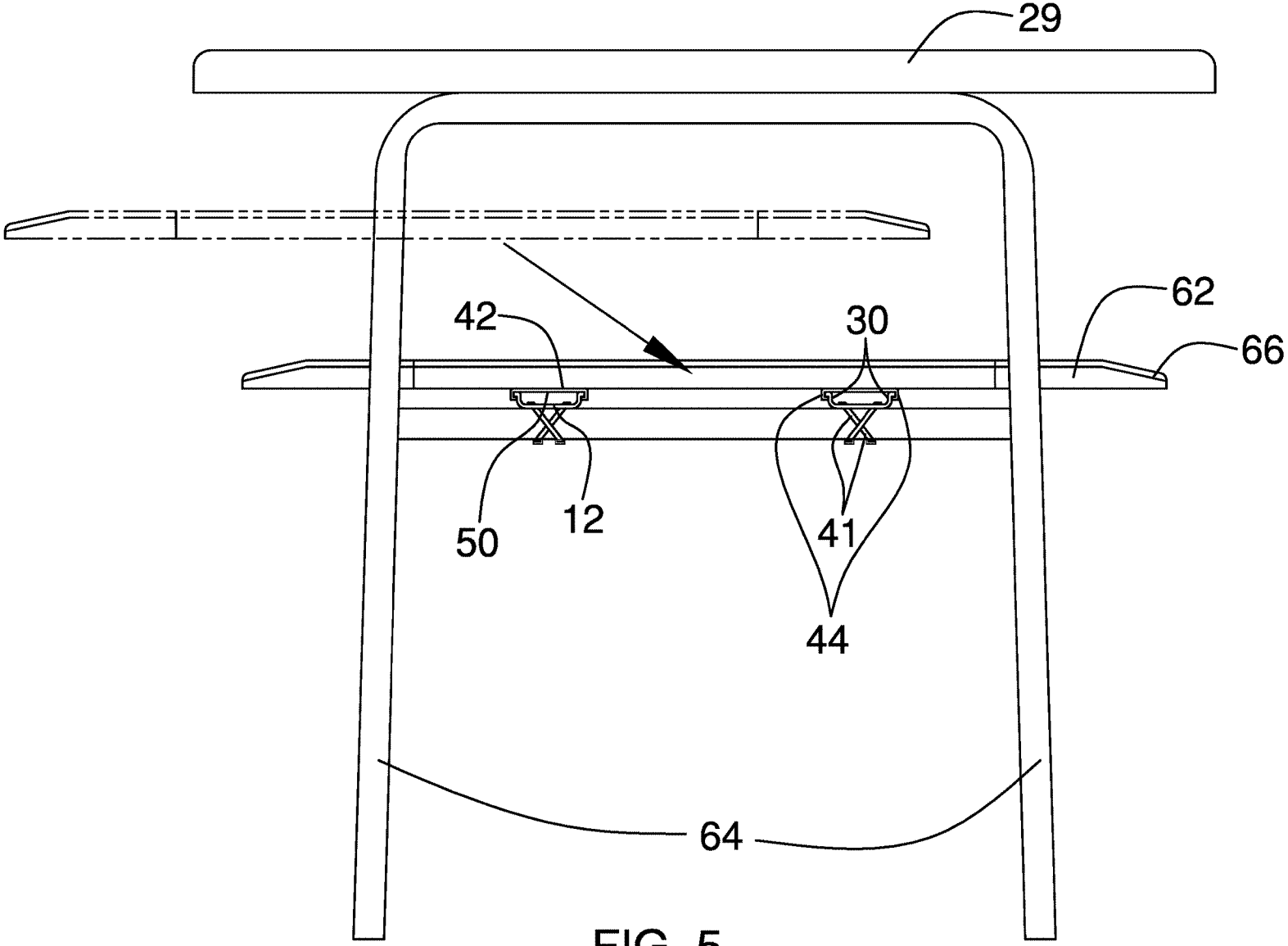
FIG. 5 is an in-use side elevation view of an embodiment of the disclosure.

With reference now to the drawings, and in particular to FIGS. 1 through 5 thereof, a new footrest embodying the principles and concepts of an embodiment of the disclosure and generally designated by the reference numeral 10 will be described.

As best illustrated in FIGS. 1 through 5, the table footrest apparatus 10 generally comprises a pair of mounting channels 12. Each of the pair of mounting channels 12 has a first end 14, a second end 16, a top side 18, and a bottom side 20. The top side 18 has a plurality of mounting apertures 22 extending through the bottom side 20 comprising a plurality of first mounting apertures 24 adjacent the first end 14 and a plurality of second mounting apertures 26 adjacent the second end 16. Each of the pair of mounting channels 12 is configured to span across a leg support ring 28 of a table 29 such that the plurality of mounting apertures 22 is above the leg support ring 28. Each of the mounting channels 12 has a pair of channel lips 30 extending from a front edge 32 and a back edge 34 of the top side 18. Each of the pair of channel lips 30 has a channel lip vertical portion 36 extending from the top side 18 and a channel lip horizontal portion 38 extending outwards from the channel lip vertical portion 36. A plurality of ties 40 is coupled to the pair of mounting channels 12. Each of the plurality of ties 40 is slidably engageable through the plurality of mounting apertures 22 and configured to secure the pair of mounting channels 12 to the leg support ring 28 of the table 29. The plurality of ties 40 comprises a pair of ties 41 for each of the first end 14 and the second end 16 of each of the pair of mounting channels 12. The pair of ties 41 is threaded through four of the plurality of mounting apertures 22 in a crossed pattern. The plurality of ties 40 may be zip ties.

A pair of channel covers 42 has a pair of cover lips 44 extending from a forward edge 46 and a rear edge 48 of a lower face 50. Each of the pair of cover lips 44 has a cover lip vertical portion 52 extending from the lower face 50 and a cover lip horizontal portion 54 extending inwards from the cover lip vertical portion 52. The pair of cover lips 44 is selectively engageable with the pair of channel lips 30. A plurality of adhesive strips 55 is coupled to the pair of channel covers 42. The plurality of adhesive strips 55 is coupled to an upper face 56 of each of the pair of channel covers 42. The plurality of adhesive strips 55 comprises a first adhesive strip 58 and a second adhesive strip 60 coupled proximal the plurality of first mounting apertures 24 and the plurality of second mounting apertures 26, respectively, of each of the pair of channel covers 42. A foot pad 62 is coupled to the pair of channel covers 42 and is selectively engageable with the plurality of adhesive strips 60. The foot pad 62 is rectangular and has a set of notched corners 63 configured to accommodate a set of legs 64 of the table 29. The foot pad 62 has chamfered edges 66 and a central umbrella aperture 68 extending therethrough. Each of the chamfered edges 66 is configured to extend over the leg support ring 28. The umbrella aperture 68 is configured to receive an umbrella pole that passes through an umbrella hole 70 of the table.

In use, the user utilizes the plurality of ties 40 to secure the pair of mounting channels 12 to the leg support ring 28. The user then engages the pair of channel covers 42 with the pair of mounting channels 12. The foot pad 62 is then placed on the pair of channel covers 42 and the user may rest her feet on the foot pad 62.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A table footrest apparatus comprising:

a pair of mounting channels, each of the pair of mounting channels having a first end, a second end, a top side, and a bottom side, the top side having a plurality of mounting apertures extending through the bottom side comprising a plurality of first mounting apertures adjacent the first end and a plurality of second mounting apertures adjacent the second end, each of the pair of mounting channels being configured to span across a leg support ring of a table such that the plurality of mounting apertures are above the leg support ring;

a plurality of ties coupled to the pair of mounting channels, each of the plurality of ties being slidably engageable through the plurality of mounting apertures and configured to secure the pair of mounting channels to the leg support ring of the table;

a pair of channel covers, the pair of channel covers being selectively engageable with the top side of the pair of mounting channels;

a plurality of adhesive strips coupled to the pair of channel covers, the plurality of adhesive strips being coupled to an upper face of each of the pair of channel covers; and a foot pad coupled to the pair of channel covers, the foot pad being selectively engageable with the plurality of adhesive strips.

2. The table footrest apparatus of claim 1 further comprising each of the mounting channels having a pair of channel lips extending from a front a front edge and a back edge of the top side, each of the channel covers having a pair of cover lips extending from a forward edge and a rear edge of a lower face, the pair of cover lips being selectively engageable with the pair of channel lips.

3. The table footrest apparatus of claim 2 further comprising each of the pair of cover lips having a cover lip vertical portion extending from the lower face and a cover lip horizontal portion extending inwards from the cover lip vertical portion, each of the pair of channel lips having a channel lip vertical portion extending from the top side and a channel lip horizontal portion extending outwards from the channel lip vertical portion.

4. The table footrest apparatus of claim 1 further comprising the foot pad being rectangular and having a set of notched corners configured to accommodate a set of legs of the table.

5. The table footrest apparatus of claim 4 further comprising the foot pad having chamfered edges.

6. The table footrest apparatus of claim 1 further comprising the foot pad having a central umbrella aperture extending therethrough, the umbrella aperture being configured to receive an umbrella pole.

7. The table footrest apparatus of claim 1 further comprising the plurality of ties comprising a pair of ties for each of the first end and the second end of each of the pair of mounting channels, the pair of ties being threaded through four of the plurality of mounting apertures in a crossed pattern.

8. The table footrest apparatus of claim 1 further comprising the plurality of adhesive strips comprising a first adhesive strip and a second adhesive strip coupled proximal the plurality of first mounting apertures and the plurality of second mounting apertures, respectively, of each of the pair of channel covers.

9. The table footrest apparatus of claim 1 further comprising the plurality of ties being zip ties.

10. A table footrest apparatus comprising:

a pair of mounting channels, each of the pair of mounting channels having a first end, a second end, a top side, and a bottom side, the top side having a plurality of mounting apertures extending through the bottom side comprising a plurality of first mounting apertures adjacent the first end and a plurality of second mounting apertures adjacent the second end, each of the pair of mounting channels being configured to span across a leg support ring of a table such that the plurality of mounting apertures are above the leg support ring, each of the mounting channels having a pair of channel lips extending from a front a front edge and a back edge of the top side, each of the pair of channel lips having a channel lip vertical portion extending from the top side and a channel lip horizontal portion extending outwards from the channel lip vertical portion;

a plurality of ties coupled to the pair of mounting channels, each of the plurality of ties being slidably engageable through the plurality of mounting apertures and configured to secure the pair of mounting channels to the leg support ring of the table the plurality of ties comprising a pair of ties for each of the first end and the second end of each of the pair of mounting channels, the pair of ties being threaded through four of the plurality of mounting apertures in a crossed pattern, the plurality of ties being zip ties;

a pair of channel covers, each of the covers having a pair of cover lips extending from a forward edge and a rear edge of a lower face, each of the pair of cover lips having a cover lip vertical portion extending from the lower face and a cover lip horizontal portion extending inwards from the cover lip vertical portion, the pair of cover lips being selectively engageable with the pair of channel lips;

a plurality of adhesive strips coupled to the pair of channel covers, the plurality of adhesive strips being coupled to an upper face of each of the pair of channel covers, the plurality of adhesive strips comprising a first adhesive strip and a second adhesive strip coupled proximal the plurality of first mounting apertures and the plurality of second mounting apertures, respectively, of each of the pair of channel covers; and a foot pad coupled to the pair of channel covers, the foot pad being selectively engageable with the plurality of adhesive strips, the foot pad being rectangular and having a set of notched corners configured to accommodate a set of legs of the table, the foot pad having chamfered edges, the foot pad having a central umbrella aperture extending therethrough, the umbrella aperture being configured to receive an umbrella pole.

11. A table and table footrest apparatus combination comprising:

a table, the table having a table top, a set of legs coupled to the table top, and a leg support ring coupled to the set of legs, the table top having a central umbrella hole extending therethrough;

a pair of mounting channels, each of the pair of mounting channels having a first end, a second end, a top side, and a bottom side, the top side having a plurality of mounting apertures extending through the bottom side comprising a plurality of first mounting apertures adjacent the first end and a plurality of second mounting apertures adjacent the second end, each of the pair of mounting channels spanning across the leg support ring of the table such that the plurality of mounting apertures are above the leg support ring, each of the mounting channels having a pair of channel lips extending from a front a front edge and a back edge of the top side, each of the pair of channel lips having a channel lip vertical portion extending from the top side and a channel lip horizontal portion extending outwards from the channel lip vertical portion;

a plurality of ties coupled to the pair of mounting channels, each of the plurality of ties being slidably engageable through the plurality of mounting apertures to secure the pair of mounting channels to the leg support ring of the table the plurality of ties comprising a pair of ties for each of the first end and the second end of each of the pair of mounting channels, the pair of ties being threaded through four of the plurality of mounting apertures in a crossed pattern, the plurality of ties being zip ties;

a pair of channel covers, each of the covers having a pair of cover lips extending from a forward edge and a rear edge of a lower face, each of the pair of cover lips having a cover lip vertical portion extending from the lower face and a cover lip horizontal portion extending inwards from the cover lip vertical portion, the pair of cover lips being selectively engageable with the pair of channel lips;

a plurality of adhesive strips coupled to the pair of channel covers, the plurality of adhesive strips being coupled to an upper face of each of the pair of channel covers, the plurality of adhesive strips comprising a first adhesive strip and a second adhesive strip coupled proximal the plurality of first mounting apertures and the plurality of second mounting apertures, respectively, of each of the pair of channel covers; and a foot pad coupled to the pair of channel covers, the foot pad being selectively engageable with the plurality of adhesive strips, the foot pad being rectangular and having a set of notched corners to accommodate a set of legs of the table, the foot pad having chamfered edges, the foot pad having a central umbrella aperture extending therethrough, the umbrella aperture receiving an umbrella pole of an umbrella.

* * * * *